United States Patent [19]

Rankin et al.

[11] Patent Number: 4,988,320

[45] Date of Patent: Jan. 29, 1991

[54] RECONFIGURABLE ANIMAL FIGURE TOY GLIDER

[75] Inventors: James Rankin; Jack V. Miller, both of Los Angeles County, Calif.

[73] Assignee: Comet Industries, Chicago, Ill.

[21] Appl. No.: 331,744

[22] Filed: Apr. 3, 1989

[51] Int. Cl.[5] ..... A63H 27/01; A63H 3/00

[52] U.S. Cl. ..... 446/62; 446/376

[58] Field of Search ..... 446/61-64, 446/66, 68, 376, 378, 230, 231, 268, 487

[56] References Cited

U.S. PATENT DOCUMENTS

| | | | |
|---|---|---|---|
| 2,410,627 | 11/1946 | Brand | 446/67 |
| 2,810,985 | 10/1957 | Bilder | 446/62 X |
| 4,109,411 | 8/1978 | Wetherell et al. | 446/61 |
| 4,512,690 | 4/1985 | Johnson | 446/61 |

*Primary Examiner*—Mickey Yu

*Attorney, Agent, or Firm*—Niro, Scavone, Haller & Niro

[57] ABSTRACT

A toy glider is provided in the form of an animal figure having an elongated fuselage, a nose section, in the form of an animal head attached by a hinge to the front end of the fuselage, a tail section in the form of a pair of animal legs terminating in feet and attached by a hinge to the rear end of the fuselage and a pair of animal wings attached to the sides of the fuselage. The feed may rest on a horizontal surface and form an animal in a biped standing position. In a preferred embodiment each wing each has a root section retained in a recess in the fuselage, and each wing has a outer section joined to the respective root section by a hinge.

The outer wing sections and the legs are all approximately the same length and are rotatable downward approximately ninety degrees so the wing tips and feet of the legs may rest on a horizontal surface and form an animal in a quadruped standing position, or the legs may rest on a horizontal surface with the torso upright to form an animal in a sitting position, and the outer wing sections may be rotated so tips are touching and the head rotated down to the wing tips to form an animal in an eating position.

11 Claims, 4 Drawing Sheets

RECONFIGURABLE ANIMAL FIGURE TOY GLIDER

BACKGROUND OF THE INVENTION

A primary purpose of the present invention is to provide a toy glider in the form of animal figure that is reconfigurable into various positions that are typical of animal activities and thereby providing greatly enhanced play value for a toy glider. Toy gliders as presently known are simply launched, glide a distance and then land. The play value lasts only a few seconds, and is generally restricted to outdoor use. The invention transforms a limited-use glider into a reconfigurable toy that may be used in play that extends to the limits of a child'imagination.

SUMMARY OF THE INVENTION

The foregoing purposes of the invention are achieved by the present invention by providing a toy glider in the form of an animal figure having an elongated fuselage generally symmetrical about a vertical plane, having a longitudinal axis, generally parallel sides, a front end and a rear end, the fuselage being generally in the form of an animal torso adapted for the mounting of a nose section, a tail section and a pair of wings. The nose section is generally in the form of an animal head and attached by a hinge to the front end of the fuselage. The tail section generally in the form of a pair of animal legs terminating in feet, with the legs parallel to the longitudinal axis of the fuselage and attached by a hinge to the rear end of the fuselage. Generally planar portions of the feet have projected areas in both the horizontal and vertical planes, and serve as horizontal and vertical stabilizers for flight. A pair of generally planar wings, are in the horizontal plane, having the form of animal wings and are attached to the sides of the fuselage.

In the preferred embodiment the head is attached to the front end of the fuselage by a first hinge having a horizontal axis and a limit stop whereat the head is generally in a horizontal plane; the pair of legs are attached to the rear end of the fuselage by a second hinge having a generally horizontal axis and a limit stop whereat the feet are generally in the horizontal plane; and each wing each has a generally flat root section, configured on a butt end to be retained in a matching recess in a respective side of the fuselage, and each wing has a outer section including a wing tip and joined to the respective root section by a hinge having a generally horizontal axis and a limit stop whereat the outer wing section is generally in the horizontal plane.

When both the head and the leg hinges are against their respective stops in the horizontal plane the feet have ends that define a generally planar surface normal to the legs, whereby the feet may rest on a horizontal surface and form an animal in a biped standing position. To accomodate changing the animal configuration the outer wing sections and the legs are approximately the same length and are rotatable on their respective hinges downward approximately ninety degrees, whereby the wing tips and the feet of the legs ay rest on a horizontal surface and form an animal in a quadruped standing position. To further change the animal configuration the legs are rotatable on their respective hinges having a second limit stop approximately ninety degrees with respect to the elongated fuselage, whereby the legs may rest on a horizontal surface and form an animal in a sitting position. In addition, the outer wing sections may be rotated about their respective hinges to a point whereat the wing tips are proximate or touching and the head may be rotated about its hinge to a point proximate the wing tips and form the configuration of an animal in an eating position.

DETAILED DESCRIPTION OF THE DRAWINGS

Figure 1:
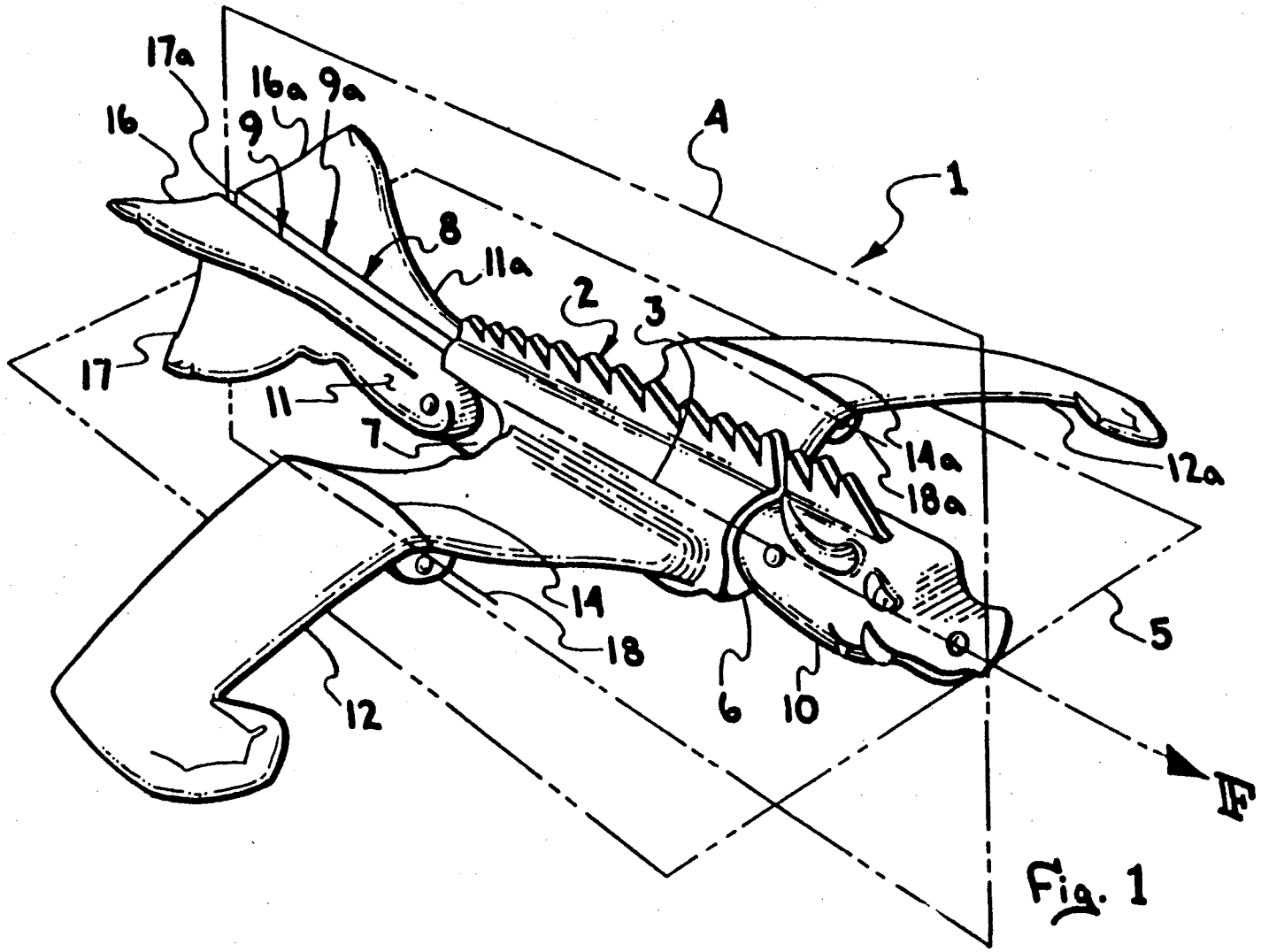
FIG. 1 shows a toy glider in the form of an animal figure in a flying configuration.

In FIG. 1 the toy glider 1 in the form of an animal figure according to the invention is shown in a normal level flying configuration in which an fuselage 2 is elongated along a flight axis 3 through which pass a vertical plane 4 and a horizontal plane 5, said fuselage having a front end 6 adapted for attachment of a simulated animal head section 10, and a rear end 7 adapted for attachment of a tail section 8 in the form of simulated animal legs 11 and 11*a*, respectively. The animal legs 11 and 11*a* are provided with simulated animal feet 9 and 9*a*, respectively, comprising generally horizontal area foot portions 16 and 16*a*, and generally vertical area foot portions 17 and 17*a*, respectively. Fuselage 2 is further adapted on each side of the vertical plane for the attachment of a pair of wings 12 and 12*a*, said wings being generally planar and disposed generally in the horizontal plane 5 and being provided with areas with cross-sectional airfoil shapes 14 and 14*a*, respectively, and having their aerodynamic chords 18 and 18*a*, respectively, configured for flight in direction F.

Figure 2:
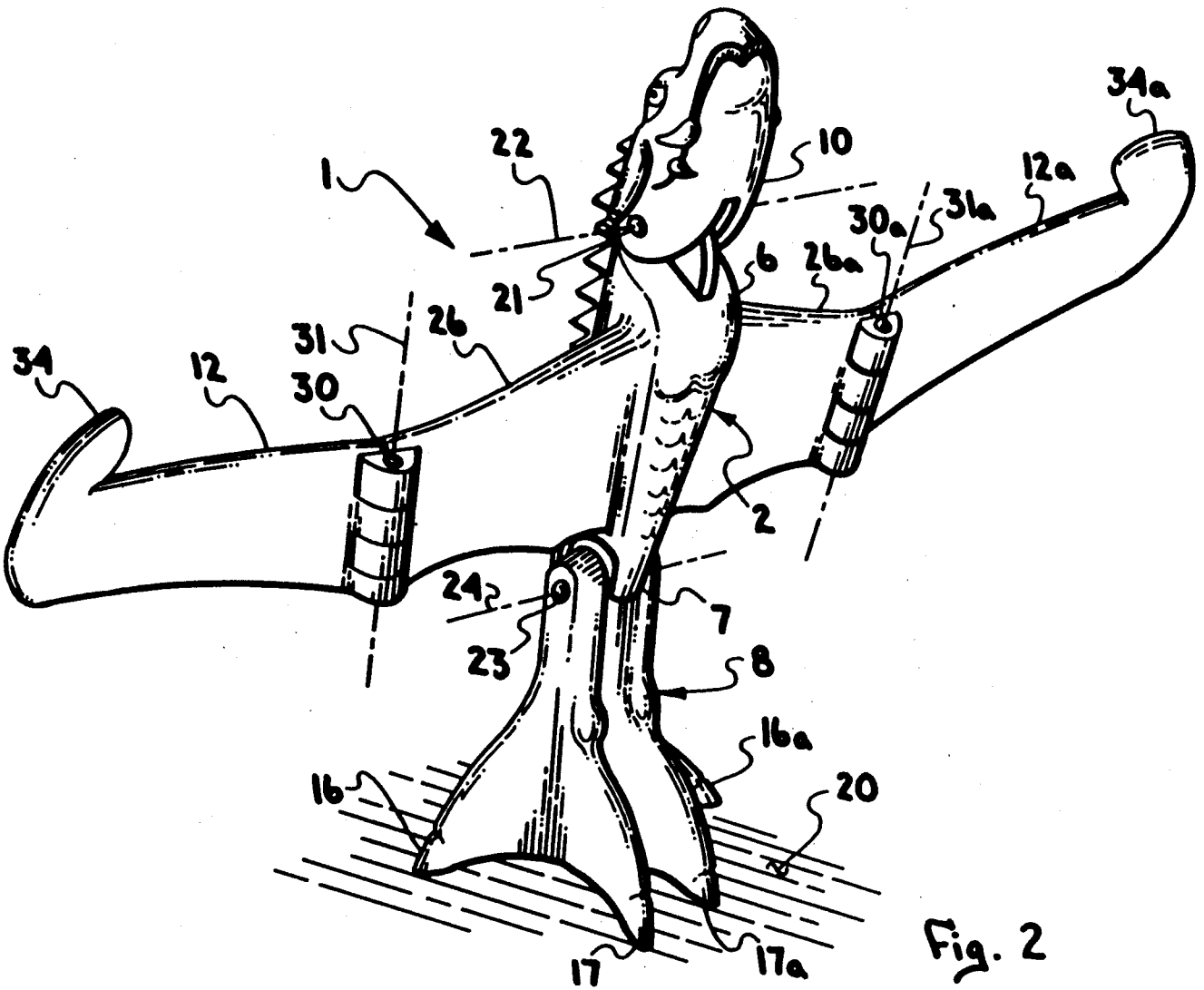
FIG. 2 shows a toy glider of FIG. 1 in the form of an animal figure in a biped standing configuration.

In FIG. 2 the toy glider 1 of FIG. 1 is shown standing in a biped position on a generally horizontal surface 20 supported on foot portions 16 and 16*a*, and 17 and 17*a*, respectively. Head section 10 is attached to front end 6 of the fuselage 2 by a first generally transverse hinge 21 so that head section 10 may rotate about first transverse hinge axis 22. Tail section 8 is attached to rear end 7 of fuselage 2 by a second generally transverse hinge 23 so that tail section 8 may rotate about second transverse hinge axis 24. Wings 12 and 12*a* are provided with wing root sections 26 and 26*a*, respectively. Wing 12 is attached to wing root 26 with a first longitudinal hinge 30 so that wing 12 may rotate about first longitudinal hinge axis 31, and wing 12*a* is attached to wing root 26*a* with a second longitudinal hinge 30*a* so that wing 12*a* may rotate about second longitudinal hinge axis 31*a*. Wings 12 and 12*a* are provided with wing tips 34 and 34*a*, respectively.

Figure 3:
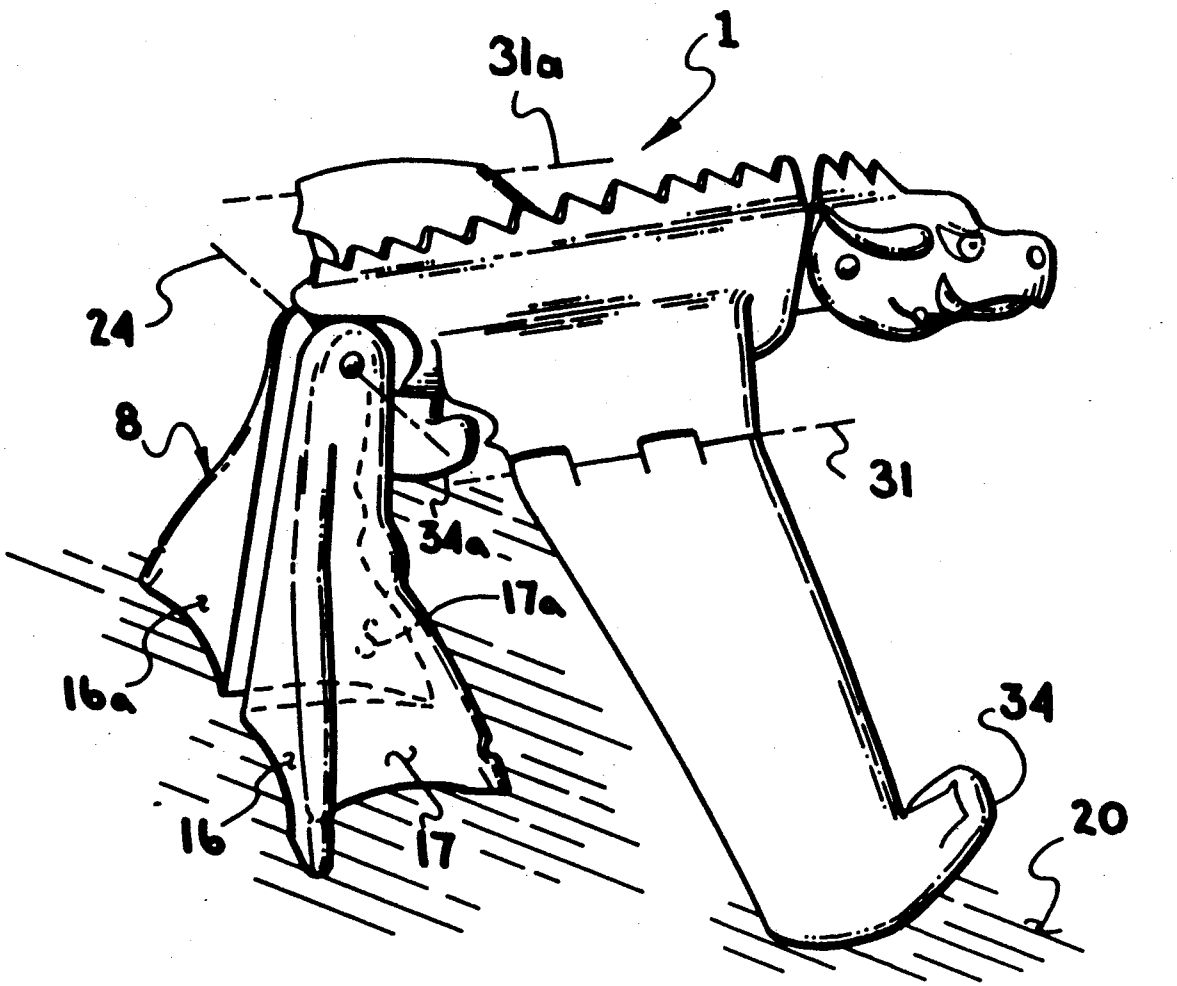
FIG. 3 shows a toy glider of FIG. 1 in the form of an animal FIG. 1 in a quadruped standing configuration.

In FIG. 3 the toy glider 1 of FIG. 1 is shown standing in a quadraped position on a generally horizontal surface 20. Tail section 8 is rotated approximately 90° about second transverse hinge axis 24 so that the simulated animal figure is supported on foot portions 16 and 16*a* and 17 and 17*a*. Wings 12 and 12*a* are also rotated approximately 90° about longitudinal hinge axes 31 and 31*a*, respectively, so that the simulated animal figure is supported on wing tips 34 and 34*a* which may be configured in the form of prehensile feet or claws.

Figure 4:
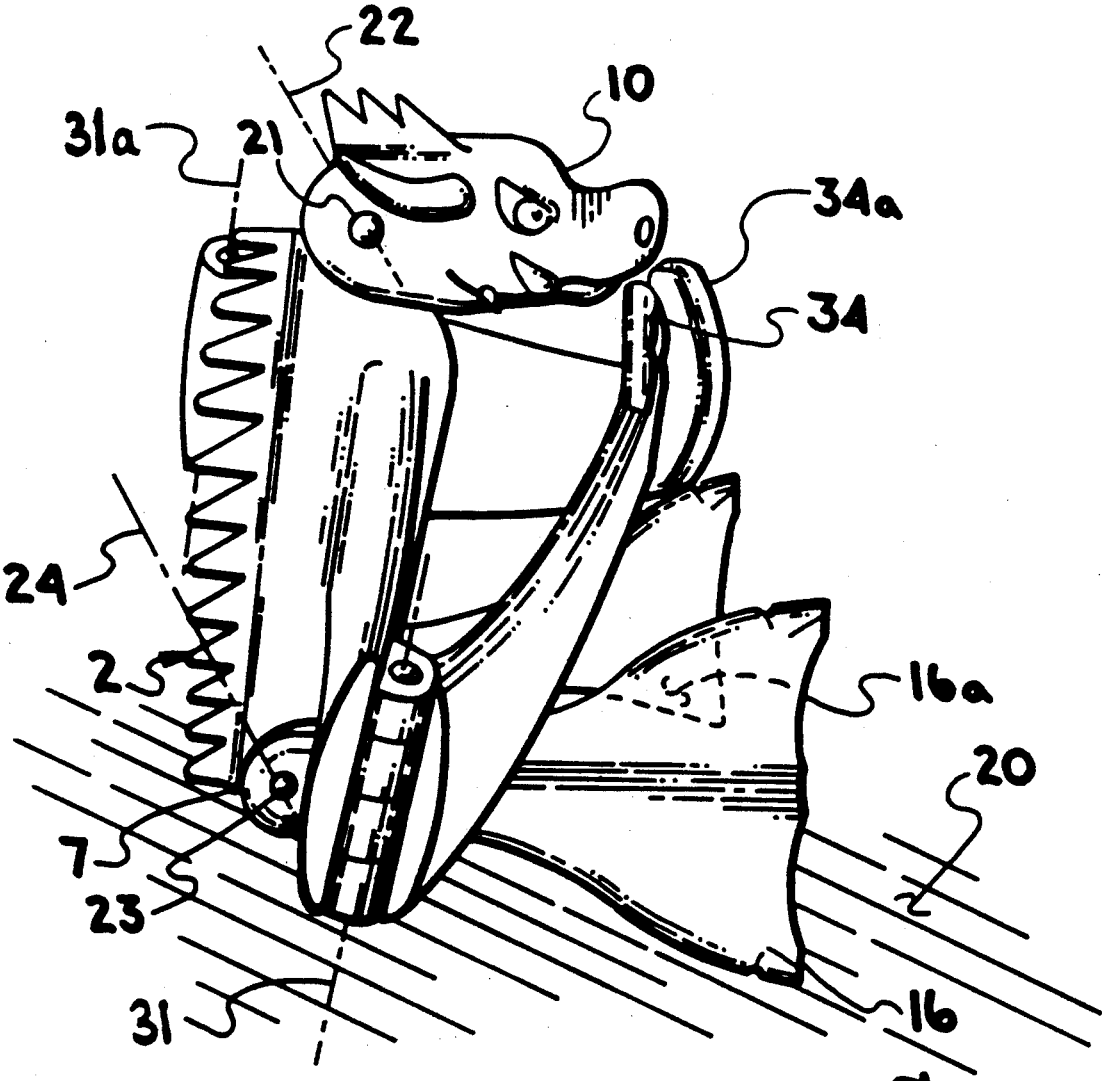
FIG. 4 shows a toy glider of FIG. 1 in the form of an animal figure in an eating, while seated, configuration.

In FIG. 4 the toy glider 1 of FIG. 1 is shown in a sitting position on a generally horizontal surface 20. Tail section 8 is rotated approximately 90° on hinge 23 about second transverse hinge axis 24 so that the simulated animal figure is supported on foot portions 16 and 16*a* and the rear end 7 of fuselage 2. Head section 10 is rotated approximately 90° on hinge 21 about the first transverse hinge axis 22. Wing 12 and 12*a* are rotated nearly 180° about longitudinal hinge axes 31 and 31*a*, respectively, so that the simulated animal figure simulates eating something held in the prehensile feet or claws of wing tips 34 and 34*a* while in a sitting position.

The primary purpose of the invention, to provide a toy glider in the form of a reconfigurable animal figure, is achieved by the invention as shown and described herein. The invention illustrates a set of proportions selected to most clearly demonstrate the functions of the toy. It is obvious that many variations may be used to produce substantially the same result. For instance, one or more of the body sections could be permanently fixed to achieve an animalistic appearance with less flexibility of play use. The aesthetic design of the animal form shown in the drawings is not to be construed as limiting the scope of the invention to the reptilian figure illustrated, but many animal forms may be adapted to the structure of the invention within the scope of the claims.

We claim:

1. A toy glider in the form of an animal figure comprising:

an elongated fuselage generally symmetrical about a vertical plane, having a longitudinal axis, generally parallel sides, a front end and a rear end, when said toy glider is in a normal horizontal flight orientation, the fuselage being generally in the form of an animal torso adapted for the mounting of a nose section, a tail section and a pair of wings;

a nose section generally in the form of an animal head and attached by a first hinge to the front end of the fuselage;

a tail section generally in the form of a pair of animal legs terminating in feet, said legs being generally parallel to the longitudinal axis and attached by a second hinge to the rear end of the fuselage;

a pair of generally planar wings, disposed in a horizontal plane, having the form of animal wings and attached to the sides of the fuselage.

2. A toy glider in the form of an animal figure according to claim 1 in which the wings have portions comprising a generally planar airfoil cross-sectional shape, and the feet have portions comprising a generally planar airfoil cross-sectional shape, with the mean aerodynamic chord of the airfoils being approximately parallel to the longitudinal axis of the fuselage.

3. A toy glider in the form of an animal figure according to claim 2 in which said feet have planar portions projected in both horizontal and vertical planes.

4. A toy glider in the form of an animal figure according to claim 1 in which the feet have ends that define a generally planar surface normal to the legs, whereby the feet may rest on a horizontal surface and form an animal in a biped standing position.

5. A toy glider in the form of an animal figure according to claim 1 in which:

the head is attached to the front end of the fuselage by said first hinge having a horizontal axis and a limit stop whereat the head is manually positionable generally in a horizontal plane;

the pair of legs are attached to the rear end of the fuselage by said second hinge having a generally horizontal axis and a first limit stop whereat the legs are manually positionable generally in the horizontal plane; and each wing each has a root section, in a respective side of the fuselage, and each wing has an outer section including a wing tip and joined to the respective root section by a hinge having a generally horizontal axis and a limit stop whereat the outer wing section is manually positionable generally in the horizontal plane.

6. A toy glider in the form of an animal figure according to claim 5 in which the outer wing sections and the legs are approximately the same length and are rotatable on their respective hinges downward approximately ninety degrees, whereby the wing tips and the feet of the legs may rest on a horizontal surface and form an animal in a quadruped standing position.

7. A toy glider in the form of an animal figure according to claim 5 in which the legs are rotatable on their respective hinge having a second limit stop approximately ninety degrees with respect to the first limit stop, whereby the legs may rest on a horizontal surface and form an animal in a sitting position.

8. A toy glider in the form of an animal figure according to claim 5 in which each one of said pair of legs is separately hinged to the rear end of the fuselage.

9. A toy glider i the form of an animal figure according to claim 5 in which each wing tip is in the form of a prehensile member.

10. A toy glider in the form of an animal figure according to claim 5 in which each wing tip is in the form of a foot.

11. A toy glider in the form of an animal figure according to claim 5 in which the outer wing sections may be rotated about their respective hinges to a point whereat the wing tips are proximate or touching and the head may be rotated about its hinge to a point proximate the wing tips and form the configuration of an animal in an eating position.

* * * * *